US007224368B2

(12) United States Patent
Estrop et al.

(10) Patent No.: US 7,224,368 B2
(45) Date of Patent: May 29, 2007

(54) RENDERING TEAR FREE VIDEO

(75) Inventors: Stephen J. Estrop, Carnation, WA (US); Joseph C. Ballantyne, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 603 days.

(21) Appl. No.: 10/732,577

(22) Filed: Dec. 10, 2003

(65) Prior Publication Data

US 2005/0128165 A1 Jun. 16, 2005

(51) Int. Cl.
*G09G 5/36* (2006.01)
*G09G 5/399* (2006.01)

(52) U.S. Cl. ..... 345/545; 345/539

(58) Field of Classification Search ..... 345/545, 345/539

See application file for complete search history.

(56) References Cited

U.S. PATENT DOCUMENTS 5,451,981 A * 9/1995 Drako et al. ..... 345/620
5,764,240 A * 6/1998 Herz ..... 345/546
2003/0169285 A1* 9/2003 Smith et al. ..... 345/716

* cited by examiner

*Primary Examiner*—Kee M. Tung
*Assistant Examiner*—Hau Nguyen
(74) *Attorney, Agent, or Firm*—Lee & Hayes, PLLC

(57) ABSTRACT

Systems and methods to render tear free video in a multi-tasking operating environment are described. In one aspect, a video playback window portion of a desktop display is divided into non-overlapping first and second partitions. As video data is scanned into display memory which maps to the first and second partitions, current scan line input positions are monitored. Responsive to determining that the current scan line position is located in display memory associated with the second partition, display memory mapped to the second partition is not rendered and display memory mapped to the first partition is rendered into the video playback window.

29 Claims, 7 Drawing Sheets

RENDERING TEAR FREE VIDEO

TECHNICAL FIELD

The invention pertains to video presentation.

BACKGROUND

Tearing is a display artifact that typically occurs when a video image or animation is modified in video memory whilst a display adapter is reading the same portion of video memory, for instance, to present the video image onto a computer display. Tearing artifacts may become particularly noticeable when rendering video into a playback window with dimensions (size) that closely match dimensions of the corresponding computer desktop. Tearing artifacts are common not only to Cathode Ray Tube (CRT) display technologies, but also across all computer display technology types.

SUMMARY

Systems and methods to render tear free video in a multitasking operating environment are described. In one aspect, a video playback window portion of a desktop display is divided into non-overlapping first and second partitions. As video data is scanned into display memory which maps to the first and second partitions, current scan line input positions are monitored. Responsive to determining that the current scan line position is located in display memory associated with the second partition, display memory mapped to the second partition is not rendered and display memory mapped to the first partition is rendered into the video playback window.

BRIEF DESCRIPTION OF THE DRAWINGS

In the figures, the left-most digit of a component reference number identifies the particular figure in which the component first appears.

DETAILED DESCRIPTION

Overview

Figure 1:
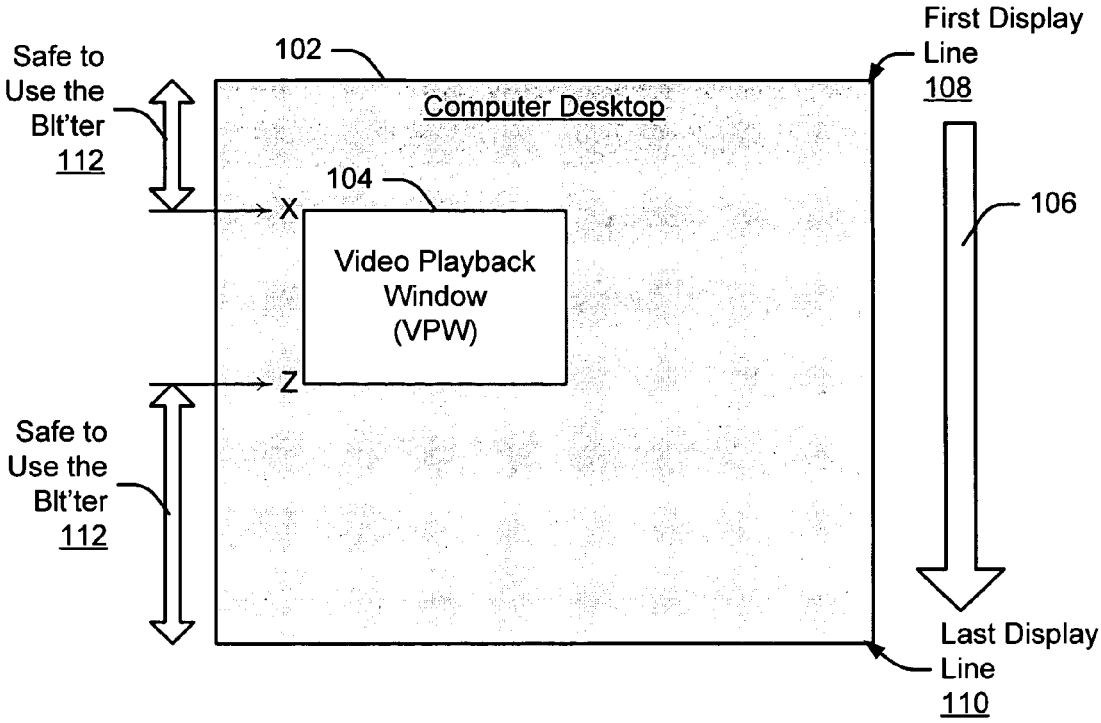
FIG. 1 shows an exemplary desktop display area of a computer display device with an embedded video playback window.

FIG. 1 shows an exemplary desktop display area 102 of a computer display monitor with an embedded video playback window 104. In this example, the display monitor comprising the desktop display area 102 is a CRT. CRT's operate by scanning out each unique display frame from a video display buffer one line at a time starting at the top of the desktop display area. In particular, and as illustrated by directional arrow 106, a CRT scans lines from left to right and working from a first display line (first line) 108 down the desktop display area 102 until the last display line (last line) 110 has been scanned out. At this point, the CRT moves back to the top of the desktop display area 102 and starts the process all over again.

Display frequency is the number of times in a second that the CRT repeats this process. Display frequencies typically range from 60, 75 and 85 refreshes per second (Hz). For a refresh rate of 60 Hz, there exactly 16 ⅔ milliseconds between each frame. The time interval between displaying the last pixel on the last line and the first pixel on the first line is know as the vertical blank period. The time interval between displaying the last pixel on line n and the first pixel on line n+1 is know as the horizontal blank period.

Bit block transfer ("blit") hardware is very efficient. For instance, existing graphics adapters are capable of modifying an entire computer display 102 in approximately 150 microseconds, which corresponds to the time needed to scan out approximately 10 lines to the display area 102. As long as the video display window is updated while the display adapter is scanning out lines from safe areas above and below the video display window 104, tearing artifacts will not occur. In this example, such safe areas are respectively denoted with arrows 112 and 114. ("Blit'ter" refers to bit block transfer hardware).

Figure 2:
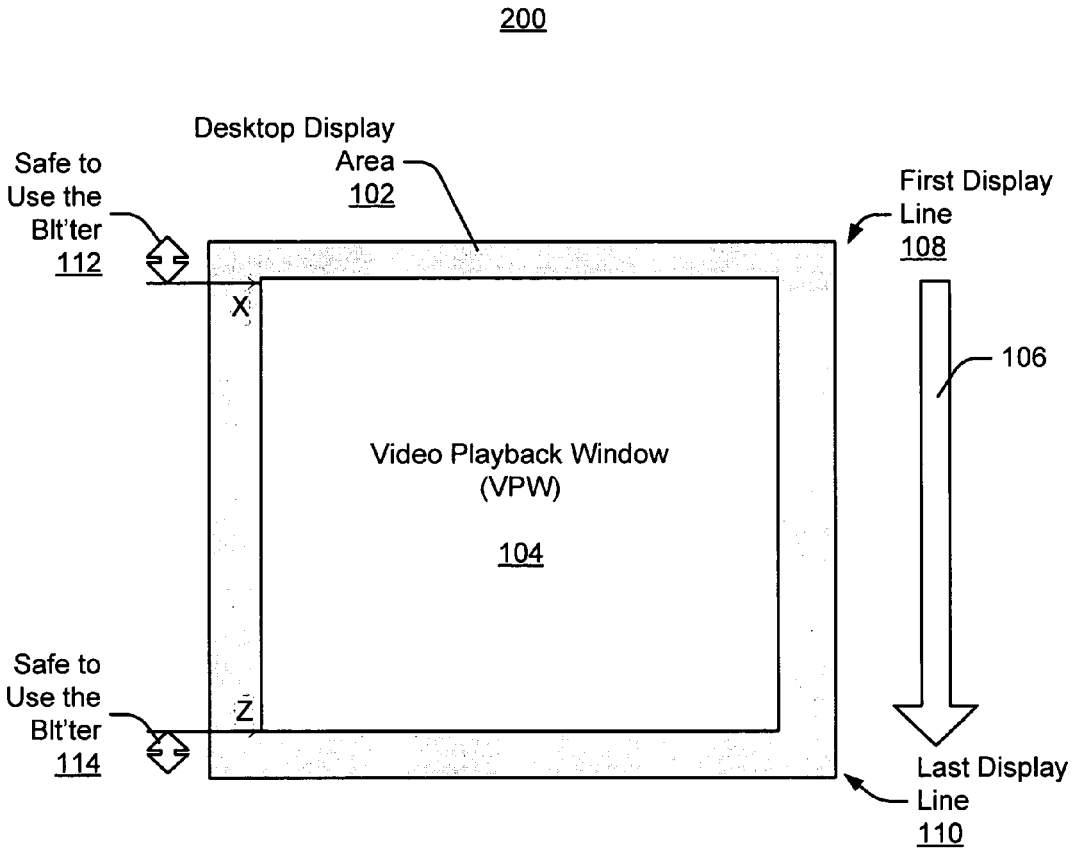
FIG. 2 shows another view of exemplary desktop display area of FIG. 1, wherein the embedded video playback window is increased in size as compared to its size in FIG. 1, such that the video playback window is almost the same size as the desktop display area.

FIG. 2 shows another view of exemplary desktop display area 102 of FIG. 1. (In the figures, the left-most digit of a component reference number identifies the particular figure in which the component first appears.) In particular, The embedded video playback window 104 of FIG. 2 is increased in size as compared to its respective size in FIG. 1, such that the video playback window is almost the same size as the desktop display area. As the video display window 104 is increased vertically in size, one or both of the safe areas 112 and 114 decrease in size. As illustrated, as the vertical size of the video display window 104 increases, available safe Blt'ing time decreases. When the video display window 104 is the same height as the computers desktop 102, the only safe Blt'ing time is during the vertical blank period. However, trying to synchronize a non-real time computer operating system (a preemptive operating system) to the vertical blank interval of the computer's display device is not possible with the necessary accuracy required to completely eliminate tearing artifacts.

To address this substantial limitation of conventional video display technology, the following described systems and methods for rendering tear free video virtually eliminate the tearing artifact without relying on real time operating system services. In particular, tearing is eliminated by ensuring that the piece of display memory mapped to a video playback window is not changed whilst the display adapter is reading from the same memory location as it generates the electrical signal sent to the display device for presentation of video. These and other aspects of the systems and methods for rendering tear free video are now described in further detail.

Exemplary Operating Environment

Turning to the drawings, wherein like reference numerals refer to like elements, the invention is illustrated as being implemented in a suitable computing environment. Although not required, the invention is described in the general context of computer-executable instructions, such as program modules, being executed by a personal computer. Program modules generally include routines, programs, objects, components, data structures, etc., that perform particular tasks or implement particular abstract data types.

Figure 3:
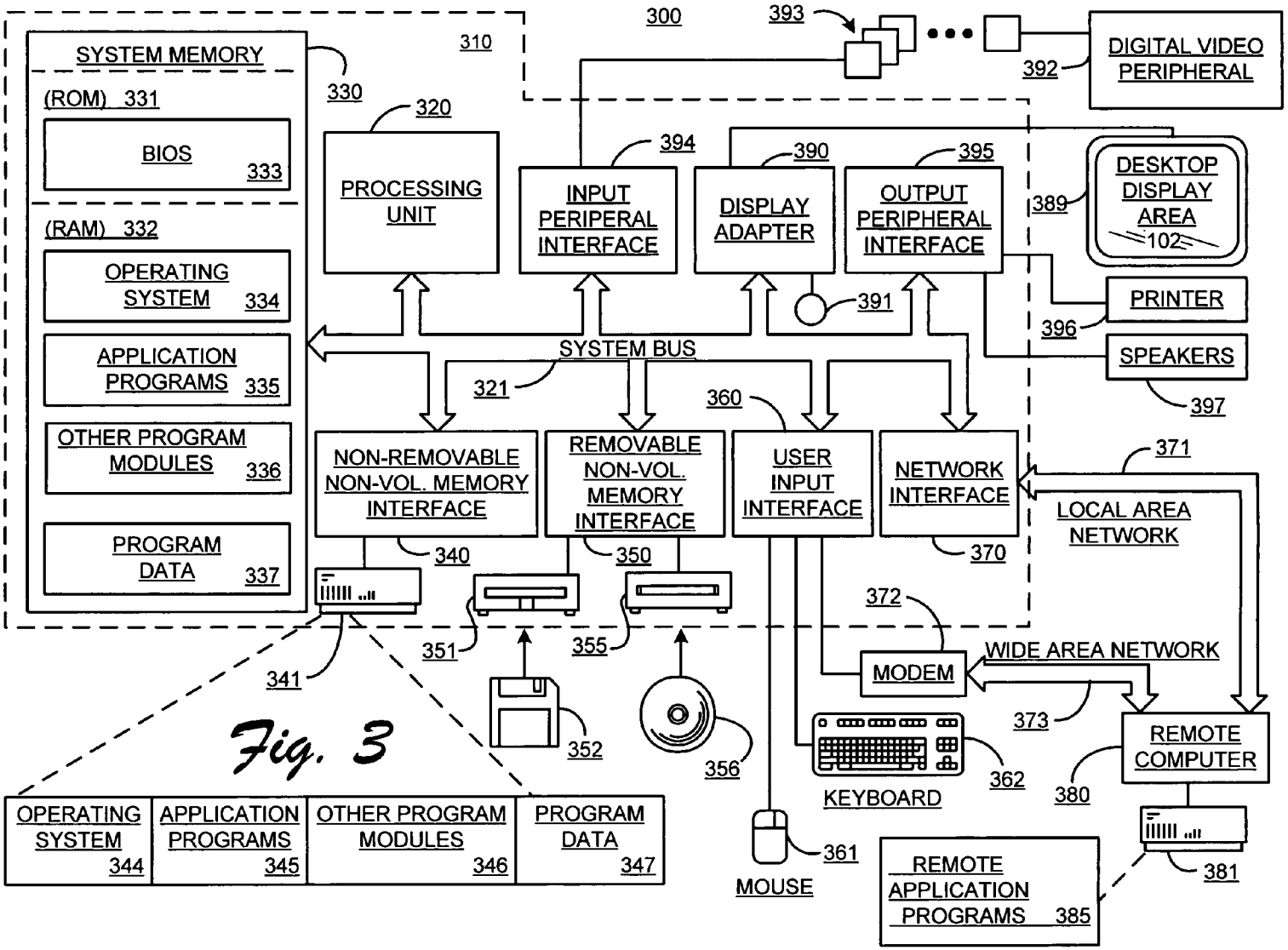
FIG. 3 illustrates an example of a suitable computing environment on which the subsequently described framework for rendering tear free video into a video playback window may be implemented.

FIG. 3 illustrates an example of a suitable computing environment 300 on which the subsequently described framework for rendering tear free video may be implemented (either fully or partially). Exemplary computing environment 300 is only one example of a suitable computing environment and is not intended to suggest any limitation as to the scope of use or functionality of systems and methods the described herein. Neither should computing environment 300 be interpreted as having any dependency or requirement relating to any one or combination of components illustrated in computing environment 300.

The methods and systems described herein are operational with numerous other general purpose or special purpose computing system environments or configurations. Examples of well known computing systems, environments, and/or configurations that may be suitable for use include, but are not limited to, personal computers, server computers, multiprocessor systems, microprocessor-based systems, network PCs, minicomputers, mainframe computers, distributed computing environments that include any of the above systems or devices, and so on. Compact or subset versions of the framework may also be implemented in clients of limited resources, such as handheld computers, or other computing devices. The invention may also be practiced in distributed computing environments where tasks are performed by remote processing devices that are linked through a communications network. In a distributed computing environment, program modules may be located in both local and remote memory storage devices.

With reference to FIG. 3, an exemplary system for rendering tear free video includes a general purpose computing device in the form of a computer 310. Components of computer 310 may include, but are not limited to, a processing unit 320, a system memory 330, and a system bus 321 that couples various system components including the system memory to the processing unit 320. The system bus 321 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 310 typically includes a variety of computer readable media. Computer readable media can be any available media that can be accessed by computer 310 and includes both volatile and nonvolatile media, removable and non-removable media. By way of example, and not limitation, computer readable media may comprise computer storage media and communication media. Computer storage media includes volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 310.

Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer readable media.

System memory 330 includes computer storage media in the form of volatile and/or nonvolatile memory such as read only memory (ROM) 331 and random access memory (RAM) 332. A basic input/output system 333 (BIOS), containing the basic routines that help to transfer information between elements within computer 310, such as during start-up, is typically stored in ROM 331. RAM 332 typically contains data and/or program modules that are immediately accessible to and/or presently being operated on by processing unit 320. By way of example, and not limitation, FIG. 3 illustrates operating system 334, application programs 335, other program modules 336, and program data 337.

The computer 310 may also include other removable/non-removable, volatile/nonvolatile computer storage media. By way of example only, FIG. 3 illustrates a hard disk drive 341 that reads from or writes to non-removable, nonvolatile magnetic media, a magnetic disk drive 351 that reads from or writes to a removable, nonvolatile magnetic disk 352, and an optical disk drive 355 that reads from or writes to a removable, nonvolatile optical disk 356 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 341 is typically connected to the system bus 321 through a non-removable memory interface such as interface 340, and magnetic disk drive 351 and optical disk drive 355 are typically connected to the system bus 321 by a removable memory interface, such as interface 350.

The drives and their associated computer storage media discussed above and illustrated in FIG. 3, provide storage of computer readable instructions, data structures, program modules and other data for the computer 310. In FIG. 3, for example, hard disk drive 341 is illustrated as storing operating system 344, application programs 345, other program modules 346, and program data 347. Note that these components can either be the same as or different from operating system 334, application programs 335, other program modules 336, and program data 337. Operating system (OS) 344, application programs 345, other program modules 346, and program data 347 are given different numbers here to illustrate that they are at least different copies. In this implementation, the OS provides a multitasking operating environment.

A user may enter commands and information into the computer 310 through input devices such as a keyboard 362 and pointing device 361, commonly referred to as a mouse, trackball or touch pad. Other input devices (not shown) may include a microphone, joystick, game pad, satellite dish, scanner, or the like. These and other input devices are often connected to the processing unit 320 through a user input interface 360 that is coupled to the system bus 321, but may be connected by other interface and bus structures, such as a parallel port, game port or a universal serial bus (USB).

A display monitor 389 or other type of display device for video display is also connected to the system bus 321 via display adapter 390. The location of display memory depends on the architecture of the graphics hardware. For instance, display memory may be shared with the processor and reside on the computers motherboard. In another implementation, display memory is part of the display adaptor 390. As the location of display memory affects the performance of the graphics hardware, best performance may be obtained when display memory is located on the display adapter. The video adapter exposes an Application Programming Interface (API) 391. The API is for communicating information such as scan line refresh rate, vertical line-height of the display device, ID of current scan line being sent to the video display, etc., to a video rendering portion of the application programs 335 to render tear free video into a video display window portion of a desktop display area 102 (FIGS. 1–3) of the display device 389. In addition to the monitor, computers may also include other peripheral output devices such as speakers 397 and printer 396, which may be connected through an output peripheral interface 395.

A video peripheral 392 such as a video camera, DVD player, and/or the like, capable of transferring video frames 393 may also be included as an input device to the computing device 310. Video data 393 from the one or more video peripherals 392 are input into the computer 310 via an appropriate data input peripheral interface 394. This interface 394 is connected to the system bus 321, thereby allowing video data 393 to be routed to and stored in the RAM 332, or one of the other data storage devices associated with the computer 310. Besides and/or in combination with the video input peripheral 392, video data 393 can be input into the computer 310 from any of the aforementioned computer-readable media.

The computer 310 may operate in a networked environment using logical connections to one or more remote computers, such as a remote computer 380. The remote computer 380 may be a personal computer, a server, a router, a handheld device such as a handheld PC, a network PC, a peer device or other common network node, and typically includes many or all of the elements described above relative to the computer 310, although only a memory storage device 381 has been illustrated in FIG. 3. The logical connections depicted in FIG. 3 include a local area network (LAN) 371 and a wide area network (WAN) 373, but may also include other networks of various implementation such as one or more wireless communication networks. Such networking environments are commonplace in homes, offices, enterprise-wide computer networks, intranets and the Internet.

When used in a LAN networking environment, the computer 310 is connected to the LAN 371 through a network interface or adapter 370. When used in a WAN networking environment, the computer 310 typically includes a modem 372 or other means for establishing communications over the WAN 373, such as the Internet. The modem 372, which may be internal or external, may be connected to the system bus 321 via the user input interface 360, or other appropriate mechanism. In a networked environment, program modules depicted relative to the computer 310, or portions thereof, may be stored in the remote memory storage device. By way of example, and not limitation, FIG. 3 illustrates remote application programs 385 as residing on memory device 381. The network connections shown are exemplary and other means of establishing a communications link between the computers may be used.

Exemplary Application Programs and Data

Figure 4:
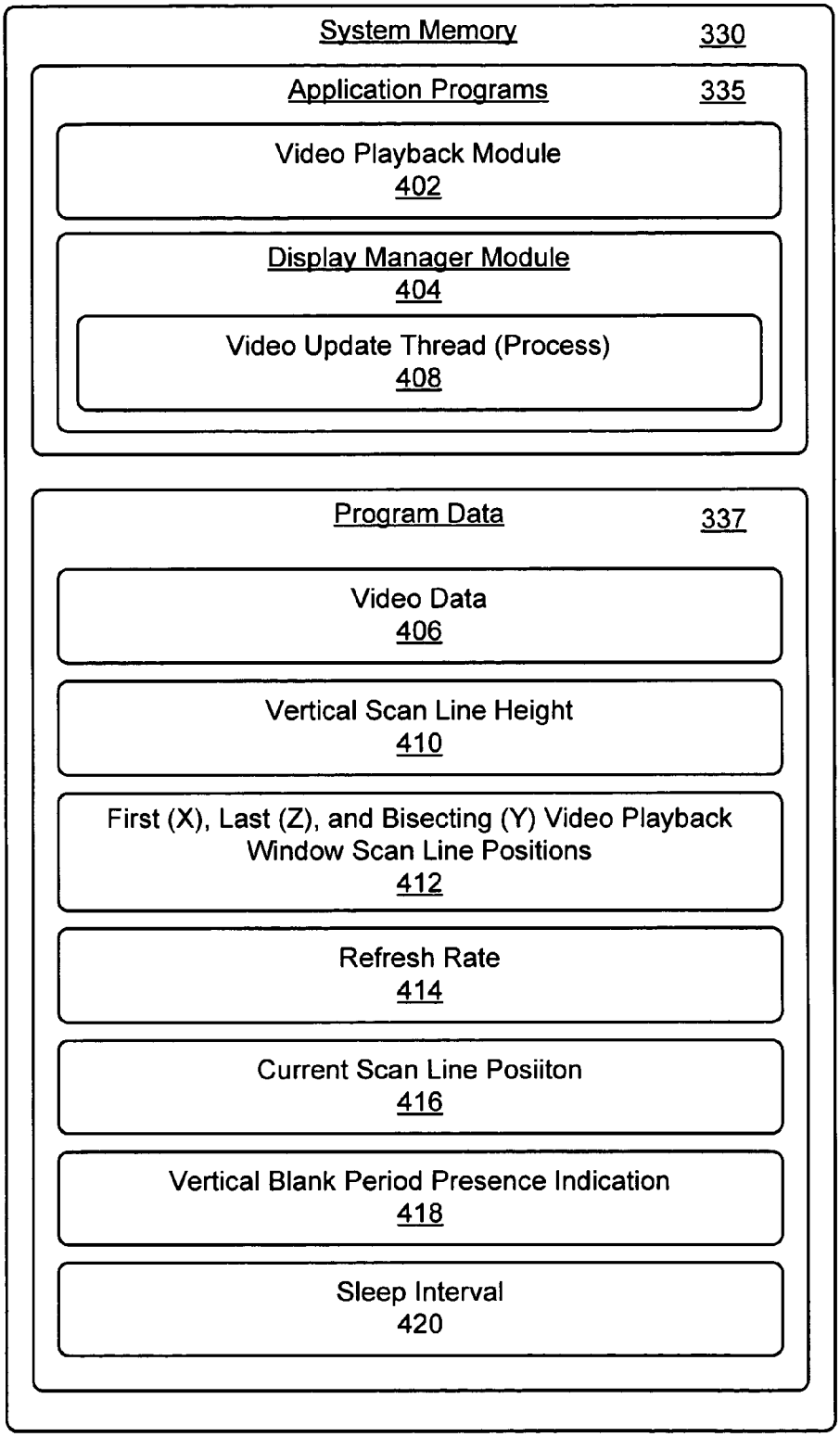
FIG. 4 is a block diagram that shows further exemplary aspects of system memory of FIG. 3, including application programs and program data for rendering tear free video.

FIG. 4 is a block diagram that shows further exemplary aspects of system memory 330 of FIG. 3, including application programs 335 and program data 337 for rendering tear free video. (In the figures, the left-most digit of a component reference number identifies the particular figure in which the component first appears). In this implementation, application programs 335 include, for example, video playback module 402, and display manager module 404. The video display module plays video data 406 for presentation in the video playback area 104 of the desktop display area 102 (FIGS. 1–3). The video data comprises multiple video frames (e.g., video frames 393 of FIG. 3). The display manager module 404 instantiates or at least manages execution of video update thread 408 for rendering tear free video data 404 into the video playback window 104. The video update thread instructs the display adapter 390 (FIG. 3) to paint/draw/render one or more specific portions of the desktop and/or video playback widow with pixel data stored in display memory. The video update thread is managed so that it will not instruct the display adapter to render any portion of display memory that is simultaneously being filled with video data 406 (scanned into) by the video playback module.

As described above in reference to FIG. 2, when the height of the video playback window 104 (FIGS. 1 and 2) approaches the height of the computers desktop 102 (FIGS. 1–3) the time available to safely update the video playback window 104 without tearing the rendered video data is greatly reduced. When the video display window is the same height as the desktop display window 102, updates are only safe during the vertical blanking period, which as described above is a substantially unsuccessful technique in a multitasking operating environment. To address this problem, and to ensure that video data 404 presented by video playback module 402 is rendered without tear artifacts (i.e., in tear free) in a multitasking operating environment, the display manager module 404 manages the execution of the video update thread 408 as a function of where the video data scan lines are currently being written to display memory.

To this end, display manager module 404 queries the display adapter 390 via exposed API 391 to determine vertical scan line height 406, which is the vertical height in scan lines of the desktop 102 based on the current display mode. The number of scan lines indicated by the vertical scan line height is used to split the video playback window 104 into two substantially equally sized vertical partitions comprising a top half (partition A) and bottom half (partition B).

Figure 5:
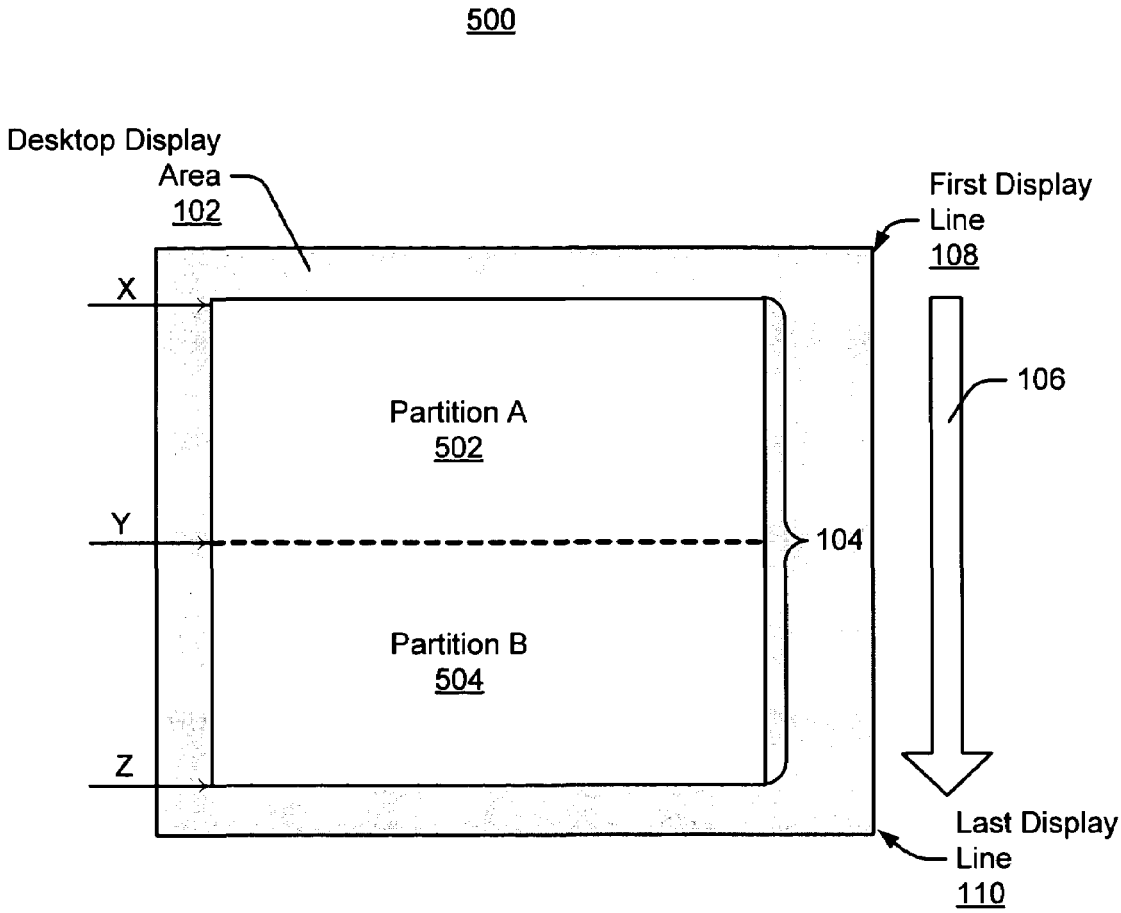
FIG. 5 shows an exemplary desktop display area, wherein a video playback window is split into two partitions for independent rendering of display memory corresponding to individual ones of the partitions.

FIG. 5 shows an exemplary desktop display area 102, wherein a video playback window 104 is split into two substantially equal and non-overlapping partitions: partition A 502 and partition B 504. Note that with respect to the video playback window, X represents a first scan line position, Y represents a bisecting scan line position (e.g., a midpoint of the video playback window), and Z represents a last scan line position. Depending on whether an even or an odd number of scan lines can be presented in the video playback window, Y may identify an exact midpoint of the video playback window, or a substantial midpoint of the video playback window (off one or more scan lines from the midpoint). For purposes of discussion the display manager module 404 (FIG. 4) calculates and stores the X, Y, and Z data values as first, last, and bisecting scan line positions 412 of FIG. 4.

Referring to FIG. 4, display manager module 402 queries display adapter 390 (FIG. 3) via API 391 (FIG. 3) to identify the rate at which that the computer monitor 389 is being refreshed (i.e., refresh rate 414), the current scan line position 416, which represents the memory location that is being or to be altered by the video playback module 402 with a scan line of video data 406, and an indication of whether a vertical blank period is present (i.e., the vertical blank period presence indication 418. The vertical blank period is a period of time when the CRT gun is moving from the bottom right corner of the display to the top left corner. The display adapter provides this indication (i.e., that the CRT gun is moving back to the top left of the screen ready to scan out the next display frame). For instance, responsive to a display adapter query for the current scan line, the display adapter returns a number between 0 and N−1, where N is the total number of display lines in a frame. However, when the display adapter is moving the CRT gun back to the top left hand corner, rather than returning the current scan line, the display adapter provides an indication of the vertical blank period.

At this point, the display manager 404 determines if the current scan line position 416 is above or below the bisecting video playback window position 412 (see, line Y of FIG. 5). If the current scan line position is above Y (e.g., in partition A 502), then the display manager directs the video update thread 408 to sleep until the current scan line position is below position Y. Techniques for directing a thread to sleep (stop execution) for a specific amount of time are known. In this implementation, the amount of time that the video update thread is instructed to sleep (i.e., sleep time 420) is a function of vertical scan line height 410, refresh rate 414, current scan line position 416, and the position of a scan line position that bisects the video playback window 104 into two partitions (see, line Y of FIG. 5).

If the current scan line position is below Y (e.g., in partition B 504), then the display manager module 404 directs the display adapter 390 (via the the video update thread 408) to render display memory mapped to partition A 502 into the video playback window 104. Recall that undesired tearing artifacts occur in conventional systems when a portion of video memory representing a computer's display monitor is altered whilst the display adapter is reading the same memory location to generate the electrical signals that are fed to the computers monitor for presentation. However, because the video playback module 402 is outputting scan line(s) into memory mapped to partition B, which is below partition A when partition A is being rendered (i.e., drawn/painted), the video data 404 rendered into partition A is free of tear artifacts.

Since the video playback module 402 is iteratively outputting video data 404 scan lines into memory associated with the video playback window 104, the display manager 404 periodically queries the display adapter 390 to identify the current scan line position 416. During the time taken to draw partition A 502 (FIG. 5) to the video playback window, the current scan line position will have changed. Accordingly, the display manager 404 queries the display adapter to determine the current scan line position, which is then compared to the last video playback window (VPW) scan line position 412 (see, line Z of FIG. 5). If the current scan line position is above the last VPW scan line position, then the display manager directs the video update thread 408 to sleep until the current scan line is at or just below the last VPW scan line position. When the update thread wakes up partition B (not partition A) is drawn to screen.

If the current scan line 416 is already below the last VPW scan line position 412, the update thread draws partition B to the screen immediately. Again, because the display adapter 390 (FIG. 3) is now updating display memory mapped below the last VPW scan line position (or possibly starting to update the next display frame) when partition B is being drawn the updated partition B is not visible on the computers monitor yet and therefore cannot tear.

TABLE 1 shows an exemplary set of pseudo code for management, as described above, of the video update thread 408 by the display manager 404 for rendering tear free video.

TABLE 1

EXEMPLARY VIDEO UPDATE THREAD MANAGEMENT

```
void DrawVideoToScreenInSlices(RECT rcVideo)
{
    // Draw top slice A
    // get the current scan line and use it
    // to determine the length of time the thread should sleep
    int sl = GetCurrentScanline( );
    int y = (rcVideo.top + rcVideo.bottom) / 2;
    int WaitA = ((y − sl) * FramePeriod) / FrameHeight;
    if (WaitA > 0)
    {
        Sleep(WaitA);
    }
    RECT rcA = {rcVideo.left, rcVideo.top,
            rcVideo.right, (rcVideo.top + rcVideo.bottom) / 2};
    DrawRectangleToScreen(&rcA);
    // Draw bottom slice B
    // get the current scan line and use it to determine the length of
    // time the thread should sleep - don't forget to account for the
    // possibility that the scan line counter may have wrapped to the
    // next display frame.
    int slOld = sl;
    sl = GetCurrentScanline( );
    if (sl < slOld)
    {
        sl += FrameHeight;
    }
    int z = rcVideo.bottom;
    int WaitB = ((z − sl) * FramePeriod) / FrameHeight;
    if (WaitB > 0)
    {
        Sleep(WaitB);
    }
    RECT rcB = {rcVideo.left, rcA.bottom, rcVideo.right,
    rcVideo.bottom};
    DrawRectangleToScreen(&rcB);
}
```

Alternate Implementations

Video Update Thread Scheduling

Ideally, after a sleep API has been called for a thread, the thread will typically not wake up until precisely the specified amount of sleep time has elapsed. However, such an ideal is not always possible in multitasking operating environments, wherein thread schedulers do not always schedule threads correctly when they request a sleep interval, for example, of one (1 millisecond. In such a scenario, video update thread 408 could wake up too soon and update a portion of the video playback window 104 whilst the display adapter 390 (FIG. 3) was scanning out video data 404 to the same portion, possibly causing a tear artifact.

In one implementation, and to overcome this limitation of multitasking thread wakeup time inaccuracies, the video update thread 408 does not sleep, as per the above describe criteria, unless the amount of time to put the video update thread 408 to sleep is greater than 1 millisecond. (The sleep time is a function of vertical scan line height 410, refresh rate 414, current scan line position 416, and the position of a scan line position that substantially bisects the video playback window 104 into two non-overlapping and independently rendered partitions (see, line Y of FIG. 5)). Instead, if the sleep time is determined to be less than or equal to 1 millisecond, the video update thread polls the display adapter 390 (FIG. 3) for the current scan line position 416 until the current scan line position has passed the bisecting VPW scanline position 412 (e.g., line Y of FIG. 5) that divides the two VPW partitions.

Only after determining that the current scan line position 416 has passed the bisecting VPW scanline position 412 does the video update thread 408 update the top partition (e.g., partition A 502 of FIG. 5). As a result, any possibility that the video update thread, after having been directed to sleep for a particular amount of time, will wake up too soon to update a first portion of the video playback window 104 before the display adapter has entered a second portion of the video playback window, wherein it is safe update area of the screen, is substantially negated. An exemplary implementation of this solution is shown in TABLE 2.

TABLE 2

AN EXEMPLARY VIDEO UPDATE THREAD SLEEP ALGORITHM

```
int WaitA = ((y – sl) * FramePeriod) / FrameHeight;
if (WaitA > 1)
{
    Sleep(WaitA);
}
else
{
    int slTemp;
    do
    {
        slTemp = GetScan line( );
    }
    while (slTemp < y);
}
```

The pseudo code of the exemplary implementation of TABLE 2 substantially solves any thread wakeup timing issues that could be introduced with respect to the video update thread 408 by conventional thread sleep implementations in a multitasking OS.

Cumulative Video Update Thread Sleep Time Reduction

When the height of the video playback window 104 is small relative to the height of the computer's desktop 102, a substantial amount of time may be spent by the video update thread 408 waiting for the current scan line position 416 to move into a safe area of the desktop 102 so that rendering into the video playback window can be performed in a tear free manner. In such a scenario, and even though video data 404 is still rendered without any tearing artifacts, this does reduce the time available for the video update thread to perform other video related tasks such as de-interlacing or color correction procedures.

In view of this, and to reduce the cumulative sleep time, the display manager compares the height of the video playback window 104 to the height of the desktop 102. For purposes of discussion, such calculated/interrogated heights are represents in respective portions of program data 337 of FIG. 3. If the video playback window height is less than half the desktop height, the original video update procedure (e.g., one without the tear free rendering aspects) is called to draw the current video image to the desktop, otherwise the described systems and procedures render tear free video (e.g., the "DrawVideoToScreenInSlices" method of TABLE 3) by updating the video playback window in slices/partitions. For instance, TABLE 3 shows exemplary pseudo code to implement alternate display update procedures as a function of video playback window and desktop height.

TABLE 3

AN EXEMPLARY DISPLAY UPDATE PROCEDURE

```
if ((rcVideo.bottom – rcVideo.top) < (FrameHeight / 2))
{
    WaitForSafePeriod(rcVideo);
    DrawRectangleToScreen(rcVideo);
}
else
{
    DrawVideoToScreenInSlices(rcVideo);
}
```

An Exemplary Procedure

Figure 6:
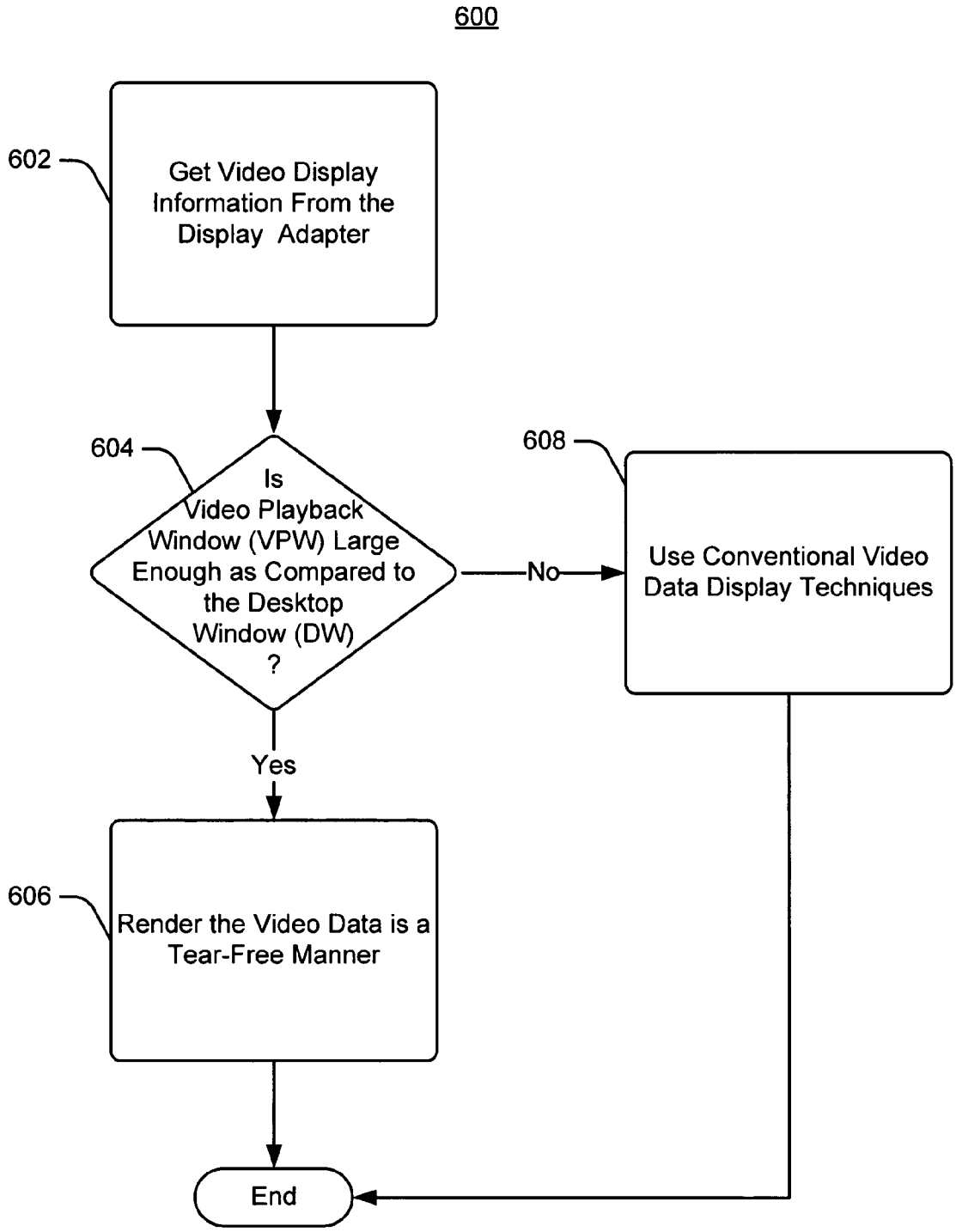
FIG. 6 shows an exemplary procedure for rendering tear free video in a multitasking computer operating environment.

FIG. 6 shows an exemplary procedure 600 for rendering tear free video in a multitasking computer operating environment. Procedure 600 is described in reference to features of FIGS. 1 through 5 and TABLES 1 through 3. As above, the left-most digit of a component reference number identifies the particular figure in which the component first appears. At block 602, the display manager module 404 interfaces with the video display adapter 390 via exposed API 391 to obtain video display information. Such video display information includes, for example, vertical scan line height 410, first, last, and bisecting scan line position data 412, refresh rate 414, and current scan line number 416. The bisecting scan line position substantially bisects the video playback window 104 into two substantially equally portions: portion A 502 and portion B 504. Although this video display information is determined at block 602, one or more aspects of the video display information can be obtained at other times and periodically as utilized.

At block 604, the display manager 404 determines whether the video playback window 104 is large enough to benefit from the described systems and methods for tear free video rendering. (As noted above, tear artifacts when presenting video data 406 in a multitasking operating system environment become substantially more prevalent when the video playback window is substantially large relative to the size of the desktop window 102). If so, at block 606, the display manager renders video data in a tear free manner. The operations of block 606 are described in greater detail below in reference to FIG. 7, as indicated by on-page reference "A" of FIG. 7. Otherwise, at block 608, the display manager utilizes conventional video data display techniques to render the video data into the video playback window.

Figure 7:
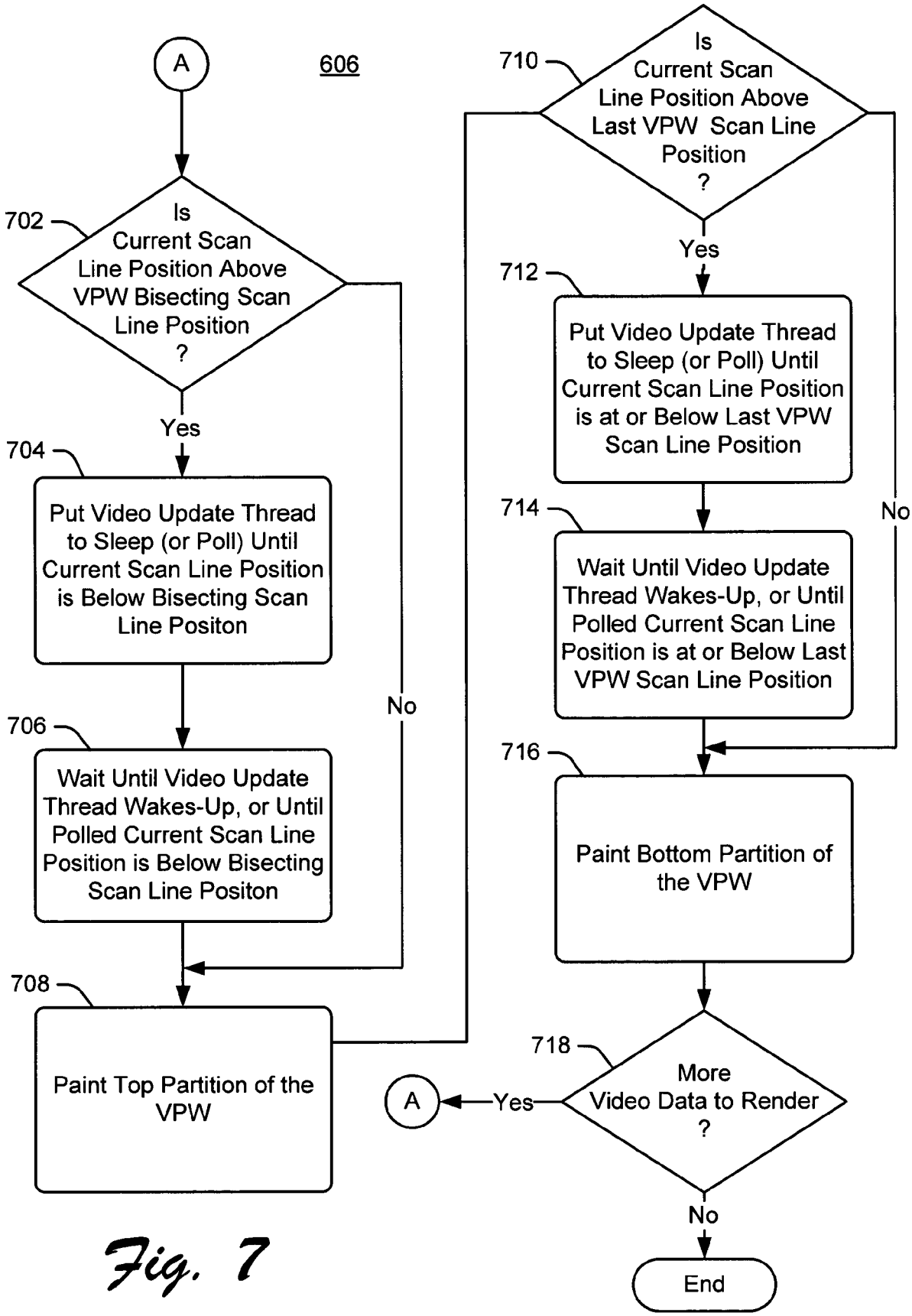
FIG. 7 shows further aspects of the exemplary procedure of FIG. 6 for rendering tear free video in a multitasking operating environment.

FIG. 7 shows further aspects of the exemplary procedure 600 for rendering tear free video in a multitasking operating environment. In particular, FIG. 7 shows exemplary operations to render tear free video as indicated in block 606 of FIG. 6. For purposes of discussion, the procedure 700 is described in reference to features of FIGS. 1 through 5 and TABLES 1 through 3. As above, the left-most digit of a component reference number identifies the particular figure in which the component first appears.

The operations of block 606 continue at on page reference "A", wherein at block 702, the display manager 404 determines whether the current scan line position 416 (FIG. 4) is above or below the video playback window 104 (FIGS. 1 and 2) bisecting scan line position 412 (FIG. 4, see also, line Y of FIG. 5). If the current scan line position is not above the bisecting scan line position, the procedure continues at block 708, as described below. However, if the current scan line position is above the bisecting scan line position, the procedure continues at block 704.

In one implementation, at block 704, video update thread 408 is put to sleep for a calculated amount of time until the current scan line position is below the bisecting scan line position. The calculated amount of time is the amount of time that it will take the video playback module 402 (FIG. 4) to output n scan lines of video data 406 (FIG. 4) to display memory. This is a function of the current scan line position, the refresh rate, the vertical scan line height, and the bisecting scan line position. In another implementation, at block 704, the display manager module 404 does not put the video update thread 408 to sleep, but rather continues to periodically track (poll) the current scan line 416 position to determine when the current scan line position is below the bisecting scan line position.

At block 706, the display manager 404 waits until the video update thread 408 wakes up, or until the pulled current scan line position is below the bisecting scan line position. At block 708, the procedure renders the top portion (portion A 502 of FIG. 5) of the video playback window 104.

At block 710, the display manager 404 determines whether the current scan line position 416 (FIG. 4) is above the last video playback window (VPW) scan line position 412. If not, the procedure continues at block 716, which is described in greater detail below. Otherwise, at block 712, the display manager directs the video update thread 408 to sleep until the current scan line position is at or below the last video playback window scan line position (see also, line Z of FIG. 5). In another implementation at block 712, the display manager continues to poll the current scan line position while comparing it to the last video playback window scan line position to determine whether the bottom half of the video display window should be rendered (presented to a user for viewing).

At block 714, the procedure waits until the video update thread 408 wakes up, or until the polled current scan line 416 is at or below the last video playback window scan line position 412. Once this has occurred, the procedure continues at block 716, wherein the video update thread renders/paints the bottom partition (partition B 504 FIG. 5) of the video playback window 104. At block 718, the procedure determines whether there's more video data 406 to render. If so, the procedure continues at on-page reference "A". Otherwise, the procedure for rendering tear free video ends.

Conclusion

The described systems and methods for rendering tear free video have been described in language specific to structural features and methodological operations. However, subject matter of the appended claims is not necessarily limited to the specific features or operations described. For instance, in this implementation, the display monitor 390 (FIG. 3) is a CRT. However, the display monitor does not need to be a CRT. In a different implementation, the display monitor is an LCD, Plasma, or some other type of display device. Accordingly, the specific features and operations are disclosed as exemplary forms of implementing the claimed subject matter.

The invention claimed is:

1. A method for rendering tear free video in a multitasking operating environment, the method comprising:

determining a vertical scan line height, wherein the vertical scan line height is based on a video playback window of a desktop display;

dividing the video playback window portion of a desktop display window into vertical non-overlapping a first partition and a second partitions;

monitoring current scan line position as video data is input into display memory mapped to the first and the second partitions;

ensuring that display memory mapped to the first and the second partition does not change while reading same memory location to generate electrical signals for presenting;

determining if the current scan line position is located in display memory mapped to the second partition:

not rendering display memory mapped to the second partition; and rendering display memory mapped to the first partition into the video playback window;

yielding a tear free video by rendering display memory mapped to the first partition into the playback window; and presenting the tear free video to an end-user.

2. A method as recited in claim 1, wherein not rendering further comprises:

calculating an amount of time for the current scan line position to correspond to display memory mapped to the second partition;

placing a video update thread to sleep for the amount of time; and wherein the rendering is performed by the video update thread after the amount of time has elapsed.

3. A method as recited in claim 1, wherein not rendering further comprises:

iteratively evaluating the current scan line position to determine when the current scan line position corresponds to display memory mapped to the second partition; and responsive to determining that the current scan line position corresponds to display memory mapped to the second partition, invoking a video update thread to perform the rendering.

4. A method as recited in claim 1, wherein the method further comprises:

if the current scan line position is located in display memory mapped to the first partition:

not rendering display memory mapped to the first partition; and rendering display memory mapped to the second partition into the video playback window.

5. A method as recited in claim 1, wherein the method further comprises:

calculating that the current scan line position is at or below a last scan line position, the last scan line position been associated with the video playback window; and responsive to the calculating:

not rendering display memory mapped to the first partition; and rendering display memory corresponding to the second partition into the video playback window.

6. A method as recited in claim 1, wherein the method further comprises:

evaluating whether the current scan line position is at or below a last scan line position, the last scan line position been associated with the video playback window;

if the current scan line position is not at or below the last scan line position:

pausing video update thread execution until a current scan line position is at or below the last scan line position; and responsive to waiting, rendering, by the video update thread, display memory associated with the second partition into the video playback window.

7. A method as recited in claim 6, wherein rendering is responsive to re-establishment of execution of the video update thread via expiration of a calculated amount of sleep time.

8. A method as recited in claim 6, wherein pausing further comprises polling a current scan line thread position until the current scan line thread position indicates that it is to be output at or below the last scan line position.

9. A method as recited in claim 1, wherein the method further comprises:

comparing relative size of the video playback window to the desktop display window;

evaluating that the relative size is substantially small; and responsive to the determining:

not performing operations associated with the determining, waiting, and rendering; and rendering the video data into the video playback window such that the rendering is not split into multiple respective partition rendering operations.

10. A computer-readable medium encoded with computer-executable instructions for rendering tear free video in a multitasking operating environment, the computer-executable instructions comprising instructions for:

determining a vertical scan line height, wherein the vertical scan line height is based on a video playback window of a desktop display;

dividing the video playback window portion of a desktop display window into vertical non-overlapping a first partition and a second partition;

monitoring current scan line position as video data is input into display memory mapped to the first and the second partitions;

ensuring that display memory mapped to the first and the second partitions does not change while reading same memory location to generate electrical signals for presenting;

determining when a scan line of video data has been output into display memory corresponding to the first partition;

responsive to determining, waiting until a scan line of the video data has been output into display memory corresponding to the second partition; and responsive to waiting:

rendering display memory for the first partition into the video playback window; and not rendering display memory for the second partition; and yielding a tear free video by the rendering display memory into the video playback window.

11. A computer-readable medium as recited in claim 10, wherein the computer-executable instructions for waiting further comprise instructions for:

calculating an amount of time for a current scan line position to correspond to display memory of the second partition; and placing a video update thread to sleep for the amount of time, the video update thread performing the rendering.

12. A computer-readable medium as recited in claim 10 wherein the computer-executable instructions for waiting further comprise instructions for iteratively evaluating a current scan line position to determine when the current scan line position is associated with the second partition.

13. A computer-readable medium as recited in claim 10, wherein the computer-executable instructions after the instructions for determining and waiting further comprise instructions for:

calculating that a current scan line position is at or below a last scan line position, the last scan line position been associated with the video playback window; and responsive to the calculating, only rendering display memory corresponding to the second partition into the video playback window.

14. A computer-readable medium as recited in claim 10, wherein the computer-executable instructions after determining and waiting further comprise instructions for:

evaluating whether a current scan line position is at or below a last scan line position, the last scan line position been associated with the video playback window;

if the current scan line position is not at or below the last scan line position:

pausing video update thread execution until a current scan line position is at or below the last scan line position; and responsive to waiting:

not rendering display memory associated with the first partition; and rendering display memory mapped to the second partition for presentation on to the video display device.

15. A computer-readable medium as recited in claim 14, wherein the computer-executable instructions for rendering are responsive to re-establishment of execution of the video update thread via expiration of a calculated amount of sleep time.

16. A computer-readable medium as recited in claim 14, wherein the instructions for pausing further comprise computer-executable instructions for polling a current scan line thread position until the current scan line thread position is at or below the last scan line position.

17. A computer-readable medium as recited in claim 10, wherein the computer-executable instructions further comprise instructions for:

comparing relative size of the video playback window to the desktop display window;

evaluating that the relative size is substantially small; and responsive to the determining:

not performing operations associated with the determining, waiting, and rendering; and rendering the video data into the video playback window such that the rendering is not split into multiple respective partition rendering operations.

18. A computing device for rendering tear free video in a multitasking operating environment, the computing device comprising:

a processor;

a memory coupled to the processor, the memory comprising computer-program instructions executable by the processor, the computer-program instructions comprising instructions for:

determining a vertical scan line height, wherein the vertical scan line height is based on a video playback window of a desktop display;

dividing the video playback window portion of a desktop display window into vertical non-overlapping a first partition and a second partition;

determining when a scan line of video data has been output into display memory corresponding to the first partition;

responsive to determining, waiting until a scan line of the video data has been output into display memory corresponding to the second partition; and responsive to waiting:

rendering display memory for the first partition into the video playback window; and not rendering display memory for the second partition; and a display device connected to processor, the display device presenting a tear free video by the rendering display memory into the video playback window.

19. A computing device as recited in claim 18, wherein the computer-program instructions for waiting further comprise instructions for:

calculating an amount of time for a current scan line position to correspond to display memory of the second partition; and placing a video update thread to sleep for the amount of time, the video update thread performing the rendering.

20. A computing device as recited in claim 18, wherein the computer-program instructions for waiting further comprise instructions for iteratively evaluating a current scan line position to determine when the current scan line position is associated with the second partition.

21. A computing device as recited in claim 18, wherein the computer-program instructions after the instructions for determining and waiting further comprise instructions for:

calculating that a current scan line position is at or below a last scan line position, the last scan line position been associated with the video playback window; and responsive to the calculating, only rendering display memory corresponding to the second partition into the video playback window.

22. A computing device as recited in claim 18, wherein the computer-program instructions after determining and waiting further comprise instructions for:

evaluating whether a current scan line position is at or below a last scan line position, the last scan line position been associated with the video playback window;

if the current scan line position is not at or below the last scan line position:

pausing video update thread execution until a current scan line position is at or below the last scan line position; and responsive to waiting:

not rendering display memory associated with the first partition; and rendering display memory mapped to the second partition for presentation on to the video display device.

23. A computing device as recited in claim 22, wherein the computer-program instructions for rendering are responsive to re-establishment of execution of the video update thread via expiration of a calculated amount of sleep time.

24. A computing device as recited in claim 22, wherein the computer-program instructions for pausing further comprise instructions for polling a current scan line thread position until the current scan line thread position is at or below the last scan line position.

25. A computing device as recited in claim 18, wherein the computer-program instructions further comprise instructions for:

comparing relative size of the video playback window to the desktop display window;

evaluating that the relative size is substantially small; and responsive to the determining:

not performing operations associated with the determining, waiting, and rendering; and rendering the video data into the video playback window such that the rendering is not split into multiple respective partition rendering operations.

26. A computing device for rendering tear free video in a multitasking operating environment, the computing device comprising:

means for determining a vertical scan line height, wherein the vertical scan line height is based on a video playback window of a desktop display;

means for dividing the video playback window portion of a desktop display window into vertical non-overlapping a first partition and a second partition;

means for monitoring current scan line position as video data is input into display memory mapped to the first and the second partitions:

means for ensuring that display memory mapped to the first and the second partitions does not change while reading same memory location;

means for determining when a scan line of video data has been output into display memory corresponding to the first partition;

responsive to determining, means for waiting until a scan line of the video data has been output into display memory corresponding to the second partition; and responsive to waiting, means for rendering the display memory for the first partition for presentation of video on a video display device; and means for presenting a tear free video into the video display device.

27. A computing device as recited in claim 26, wherein after the means for determining and waiting, the computing device further comprises:

means for calculating that a current scan line position is at or below a last scan line position, the last scan line position been associated with the video playback window; and responsive to the calculating, means for rendering display memory corresponding to the second partition for presentation on the video display device.

28. A computing device as recited in claim 26, wherein after the means for determining and waiting, the computing device further comprises:

means for evaluating whether a current scan line position is at or below a last scan line position, the last scan line position been associated with the video playback window;

if the current scan line position is not at or below the last scan line position rendering the second partition:

means for pausing video update thread execution until a current scan line position is at or below the last scan line position; and responsive to waiting, means for rendering the video memory associated with the second partition for presentation on to the video display device.

29. A computing device as recited in claim 26, wherein the computing device further comprises:

means for comparing relative size of the video playback window to the desktop display window;

means for evaluating that the relative size is substantially small; and responsive to the determining:

means for not performing operations associated with the determining, waiting, and rendering; and means for rendering the video data into the video playback window such that the rendering is not split into multiple respective partition rendering operations.

* * * * *